US007124480B2

(12) United States Patent
Kawai et al.

(10) Patent No.: US 7,124,480 B2
(45) Date of Patent: Oct. 24, 2006

(54) SHOCK-PROOF DEVICE, BUCKLE HAVING THE SHOCK PROOF DEVICE, AND SEATBELT APPARATUS HAVING THE BUCKLE

(75) Inventors: Yoshihiko Kawai, Hikone (JP); Takaaki Kimura, Shiga (JP)

(73) Assignee: Takata Corporation, Tokyo (JP)

( * ) Notice: Subject to any disclaimer, the term of this patent is extended or adjusted under 35 U.S.C. 154(b) by 115 days.

(21) Appl. No.: 10/912,194

(22) Filed: Aug. 6, 2004

(65) Prior Publication Data

US 2005/0086777 A1 Apr. 28, 2005

(30) Foreign Application Priority Data

Oct. 24, 2003 (JP) ..... 2003-364224
May 18, 2004 (JP) ..... 2004-147320

(51) Int. Cl.
*A44B 11/26* (2006.01)

(52) U.S. Cl. ..... 24/633; 24/641

(58) Field of Classification Search ..... 24/633, 24/641, 642, 636, 647
See application file for complete search history.

(56) References Cited

U.S. PATENT DOCUMENTS 5,142,749 A * 9/1992 Biller ..... 24/636
5,213,365 A * 5/1993 Föhl ..... 24/633
5,496,068 A 3/1996 Ball et al.
5,555,609 A * 9/1996 Tolfsen et al. ..... 24/641
5,595,400 A * 1/1997 Wier ..... 24/633
5,765,266 A 6/1998 Betz
5,915,633 A 6/1999 Biller
6,170,134 B1 * 1/2001 Downie et al. ..... 24/641
6,233,794 B1 5/2001 Kohlndorfer et al.

FOREIGN PATENT DOCUMENTS

| | | |
|---|---|---|
| DE | G92 02 525.0 | 5/1992 |
| DE | G 92 02 526.9 | 5/1992 |
| EP | 0 557 983 | 5/1906 |
| GB | 2314879 | 1/1998 |

* cited by examiner

*Primary Examiner*—Robert J. Sandy
(74) *Attorney, Agent, or Firm*—Manabu Kanesaka

(57) ABSTRACT

A shock-proof device disposed in a buckle includes at least a latch member for engaging a tongue so as to latch the tongue; a release button for releasing the tongue from the latch member; and an inertia lever with a rotation shaft rotatably arranged for preventing the release button from moving at least in a release direction of the release button by abutting against the release button. The shock-proof device further includes torque-difference generating mechanism for generating a torque difference between a first torque and a second torque. The first torque is applied to the inertia lever when the inertial force is applied to the release button and the inertia lever in the release direction of the release button. The second torque is applied to the inertia lever when the inertial force is applied to the release button and the inertia lever in the non-release direction of the release button.

14 Claims, 10 Drawing Sheets

(a)

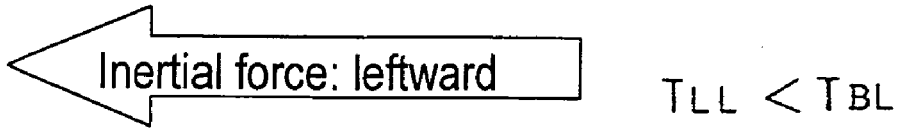
Fig. 9
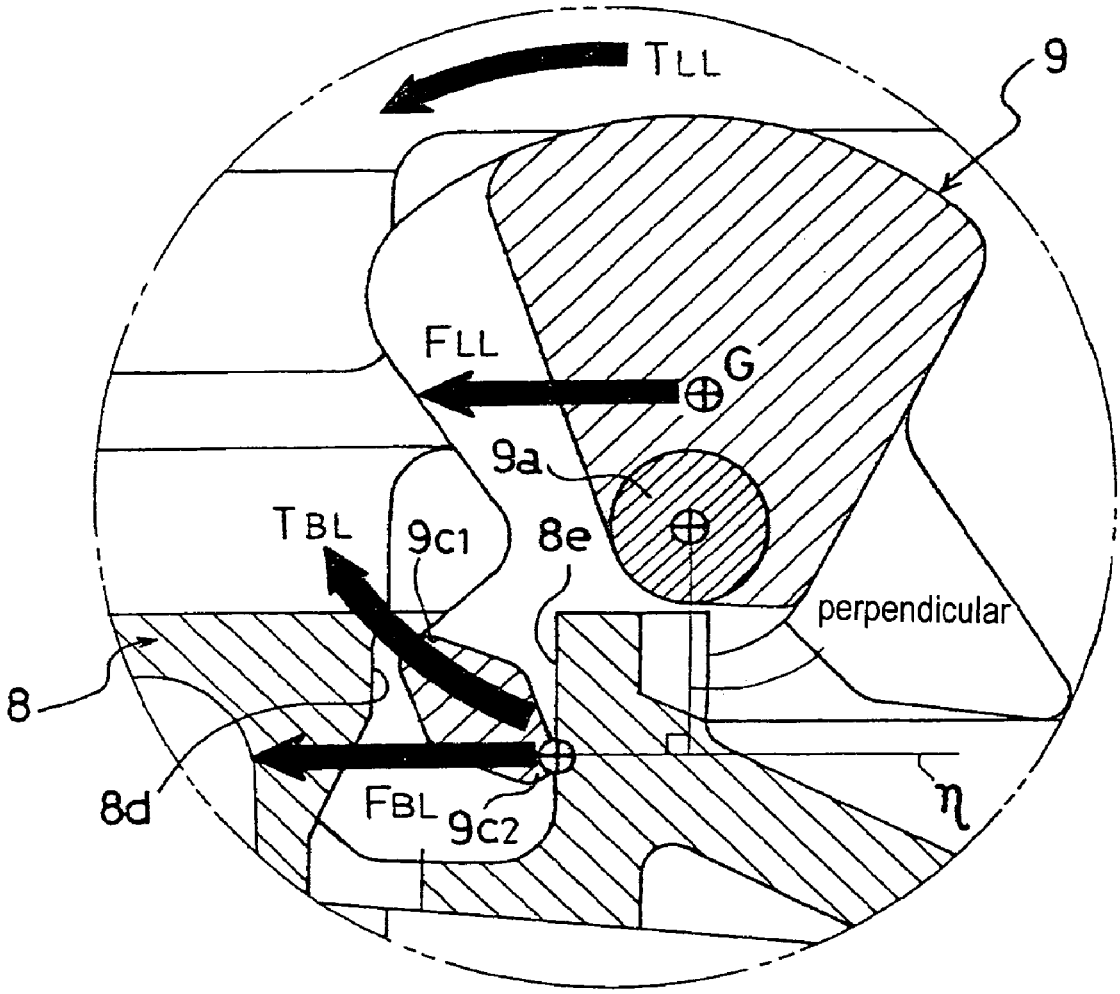

(a)

SHOCK-PROOF DEVICE, BUCKLE HAVING THE SHOCK PROOF DEVICE, AND SEATBELT APPARATUS HAVING THE BUCKLE

BACKGROUND OF THE INVENTION AND RELATED ART STATEMENT

The present invention relates to a seatbelt apparatus equipped in a seat of an automobile or other transportation vehicles and a buckle of the seatbelt apparatus and, in particular, relates to a shock-proof device provided in the buckle for preventing a release button from releasing the buckle by inertia from a tongue inserted into and retained to the buckle using an inertia lever.

A seat of an automobile and various kinds of transportation vehicles has been equipped with a seatbelt for protecting an occupant from collision. In such a seatbelt, there is usually provided a buckle to simply put on or off the seatbelt. The buckle has a latch member having a claw for engaging a tongue urged by a spring in an engaging direction. In such a buckle, the tongue attached to the seatbelt is inserted into the buckle so that the latch member of the buckle engages the tongue, and then the latch member is held to the tongue with a release-preventing pin in an engaged state so as to fit the seatbelt to an occupant. A release button for releasing the engagement between the tongue and the buckle is pressed in a releasing direction so as to move the release-preventing pin to a non-retention position, thereby releasing the tongue from the buckle.

In order to securely engage the tongue with the buckle when a vehicle receives a large impact during a vehicle collision, various buckles having a shock-proof device have been proposed in which an inertia lever is rotatably provided in a body base for preventing the release button from moving in the releasing direction (see Deutsche Offenlegungsschrift No. 9202526.9 (DE9202526.9U1)).

In the buckle disclosed in Deutsche Offenlegungsschrift No. 9202526.9 (DE9202526.9U1), an inertial force of the release button itself is applied to the inertia lever on a surface perpendicular to the moving direction of the release button in any one of release and non-release directions of the release button.

In the shock-proof device disclosed Deutsche Offenlegungsschrift No. 9202526.9 (DE9202526.9U1), when the inertial force is applied in the release direction, the inertia lever prevents the release button from moving. However, it is necessary to increase moment of the inertial force of the inertia lever to be greater than that of the inertial force of the release button in order to securely prevent the movement in the non-release direction.

When the moments are set in such a manner, in the shock-proof device, when the inertial force is applied to the release button in the non-release direction, the release button attempts to move in the non-release. Since the inertia lever has an engagement part with a circular cross-section for engaging two vertical planes of the release button, the moment of the inertial force of the inertia lever becomes larger than that of the inertial force of the release button, so that the inertia lever may move the release button in the release direction.

Accordingly, it is necessary to set the moment of the inertial force of the inertia lever identical to that of the inertial force of the release button, so that the inertia lever does not move the release button in the release and non-release directions. In the shock-proof device, it is possible to set the moments identical. In this case, however, it is difficult to securely prevent the release button from moving in the release direction by the inertia lever when the inertial force is applied to the release button in the release and non-release directions.

As described above, in the shock-proof device disclosed in Deutsche Offenlegungsschrift No. 9202526.9 (DE9202526.9U1), it is difficult to prevent the disengagement between the tongue and the buckle depending on a direction of the inertial force.

In view of problems described above, the present invention has been made, and an object of the present invention is to provide a shock-proof device disposed in a buckle capable of securely preventing the disengagement between a tongue and a buckle regardless of a direction of the inertial force, a buckle having the shock-proof device, and a seatbelt apparatus having the buckle.

Further objects and advantages of the invention will be apparent from the following description of the invention.

SUMMARY OF THE INVENTION

In order to attain the objects described above, according to a first aspect of the present invention, a shock-proof device disposed in a buckle includes at least a latch member for engaging a tongue so as to latch the tongue; a release button for releasing the tongue from the latch member; and an inertia lever with a rotation shaft rotatably arranged for preventing the release button from moving at least in a release direction of the release button by abutting the release button. The shock-proof device further includes torque-difference generating mechanism for generating a torque difference between a first torque and a second torque. The first torque is applied to the inertia lever by an inertial force of the release button in the release direction when the inertial force is applied to the release button and the inertia lever in the release direction of the release button, respectively, so that the release button abuts against the inertia lever. The second torque is applied to the inertia lever by an inertial force in a non-release direction of the release button when the inertial force is applied to the release button and the inertia lever of the release button in the non-release direction, respectively, so that the release button abuts against the inertia lever.

According to a second aspect of the present invention, in the shock-proof device, the first torque is set to be smaller than the second torque.

According to a third aspect of the present invention, in the shock-proof device, the torque-difference generating mechanism includes an inclined surface inclined relative to a movement direction of the release button for abutting against at least one of a first abutting surface of the release button abutting against the inertia lever when the inertial force of the release button is applied in the release direction, and a second abutting surface of the release button abutting against the inertia lever when the inertial force of the release button is applied in the non-release direction.

According to a fourth aspect of the present invention, in the shock-proof device, the torque-difference generating mechanism sets a length of a perpendicular line from the center of the rotation shaft of the inertia lever to an action line of a force of the release button applied to the inertia lever by the inertial force in the release direction of the release button smaller than that of a perpendicular line from the center of the rotation shaft of the inertia lever to an action line of a force of the release button applied to the inertia lever by the inertial force in the non-release direction of the release button.

According to a fifth aspect of the present invention, in the shock-proof device, the inertia lever has an abutting part abutting against the release button and having an elongated cross-section extending in a direction perpendicular to a straight line between the center of the cross-section of the abutting part and the center of the inertia lever.

According to a sixth aspect of the present invention, the shock-proof device further includes an inertial mass for applying a torque to the inertia lever. The inertial mass applies the torque due to an inertial force thereof to the inertia lever when an inertial force of the release button is applied in the non-release direction.

According to a seventh aspect of the present invention, a buckle includes the shock-proof device according to one of the first to sixth aspects.

According to an eighth aspect of the present invention, a seatbelt apparatus includes at least a seatbelt for restraining an occupant; a tongue movably supported to the seatbelt; and a buckle for engaging the tongue. The seatbelt is mounted on the occupant by engaging the tongue to the buckle, and the buckle comprises the buckle according to the seventh aspect.

In the shock-proof device structured as described above according to the first to sixth aspects and the buckle according to the seventh aspect, the torque-difference generating mechanism generates a torque difference between the first torque acting to the inertia lever by the inertial force of the release button in the release direction and the second torque acting to the inertia lever by the inertial force of the release button in the non-release direction. Accordingly, when the inertial force of the release button is applied in the release direction, the first torque acting on the inertia lever can be reduced to be comparatively small, thereby preventing the release button from moving in the release direction with the inertia lever. When the inertial force of the release button is applied in the non-release direction, the second torque acting on the inertia lever can be increased to be comparatively large. Accordingly, even if the release button is urged in the release direction by the inertia lever, the release button can be securely prevented from moving in the release direction by the release button having an inertial force applied thereto in the non-release direction. Thus, it is possible to reliably maintain the engagement between the buckle and the tongue regardless of the inertial force in the release or non-release direction.

In the shock-proof device according to the second aspect, the first torque is set to be smaller than the second torque. Accordingly, when the inertial force is applied in the release or non-release direction, the release button can be effectively prevented from moving in the release direction, so that the engagement between the buckle and the tongue can be securely maintained.

In the shock-proof device according to the third aspect, the torque-difference generating mechanism includes the inclined surface or plane of the release button, thereby making a structure of the torque-difference generating mechanism simple.

In the shock-proof device according to the fourth aspect, the torque-difference generating mechanism sets a length of a perpendicular line from the center of the rotation shaft of the inertia lever to an action line of a force of the release button applied to the inertia lever by the inertial force in the release direction smaller than that of a perpendicular line from the center of the rotation shaft of the inertia lever to an action line of a force of the release button applied to the inertia lever by the inertial force in the non-release direction. Accordingly, it is possible to securely reduce the first torque to be smaller than the second torque.

In the shock-proof device according to the fifth aspect, the abutting part of the inertia lever abutting against the release button has a simple elongated cross-section extending in a direction perpendicular to a straight line between the center of the cross-section of the abutting part and the center of the inertia lever, thereby making it easy to set the lengths of the perpendicular lines according to the fourth aspect.

In the shock-proof device according to the sixth aspect, the inertial mass applies a torque due to an inertial force thereof to the inertia lever when the inertial force of the release button is applied in the non-release direction, so that the torque difference of the inertia lever can be generated with a simple structure.

In the seatbelt apparatus according to the eighth aspect, the apparatus includes the buckle having the shock-proof device according to the present invention, so that even if an inertial force is applied to the buckle in the release direction, an occupant sitting on a vehicle seat can be more securely restrained and protected with the seatbelt.

BRIEF DESCRIPTION OF THE DRAWINGS

FIG. 9 is a view showing an action of the release button and the inertia lever when an inertial force is applied in a non-release direction of the buckle shown in FIG. 7(*a*)

DETAILED DESCRIPTION OF PREFERRED EMBODIMENTS

Figure 1:
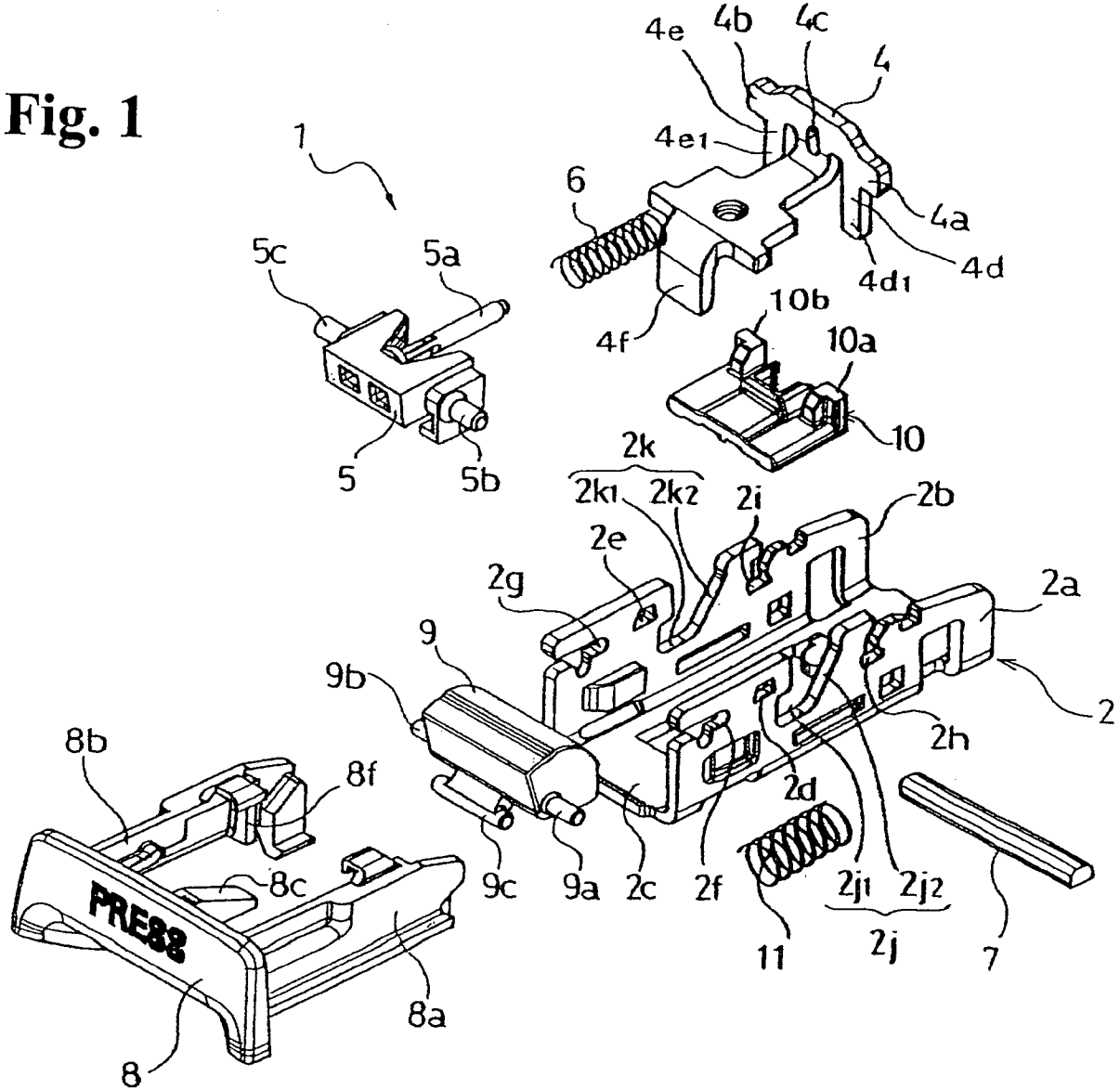
FIG. 1 is an exploded perspective view of a buckle of a shock-proof device according to an embodiment of the present invention.
Figure 2A:
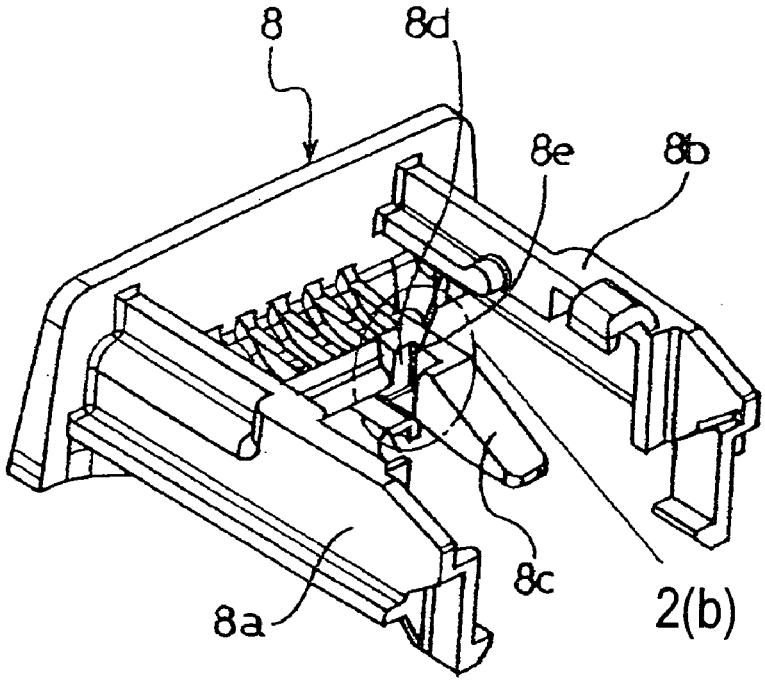
FIGS. 2(*a*) and 2(*b*) are views showing a release button of the buckle shown in FIG. 1, wherein FIG. 2(*a*) is a perspective view viewed from a direction opposite to that in FIG. 1, and FIG. 2(*b*) is an enlarged view of portion 2(*b*) in FIG. 2(*a*)
Figure 2B:
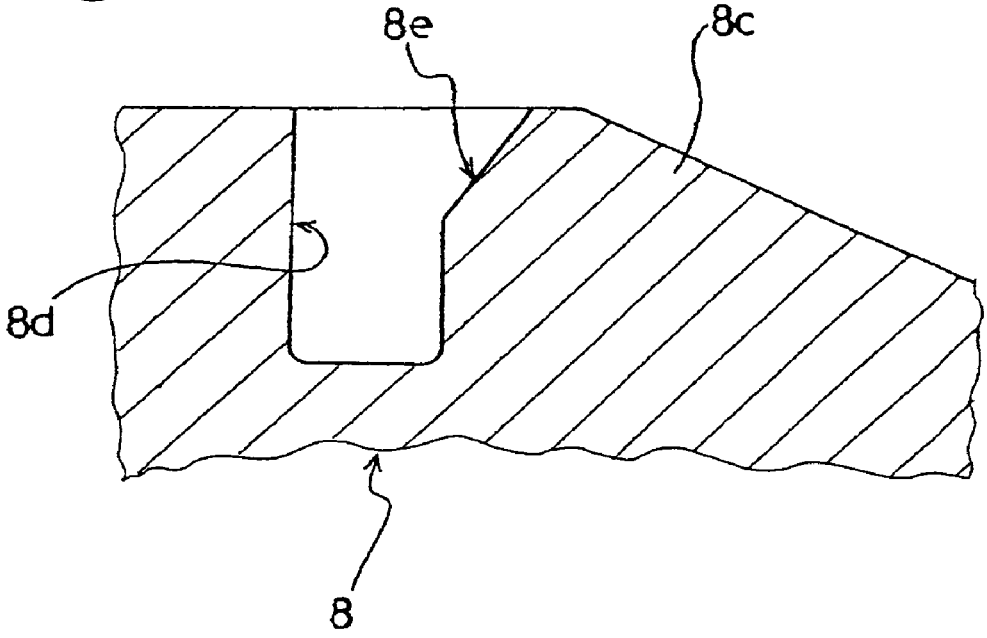
Figure 3A:
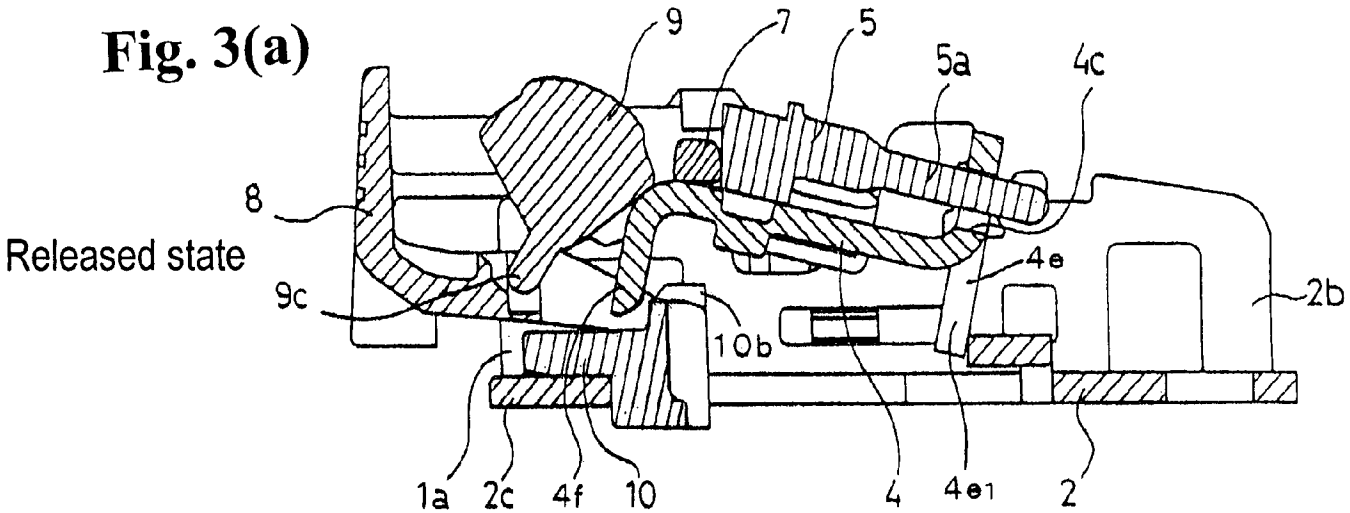
FIGS. 3(*a*) and 3(*b*) are views showing the buckle shown in FIG. 1, wherein FIG. 3(*a*) is a longitudinal sectional view in a non-latch (disengagement) state to a tongue, and FIG. 3(*b*) is a sectional view showing a latch (engagement) state to the tongue.
Figure 3B:
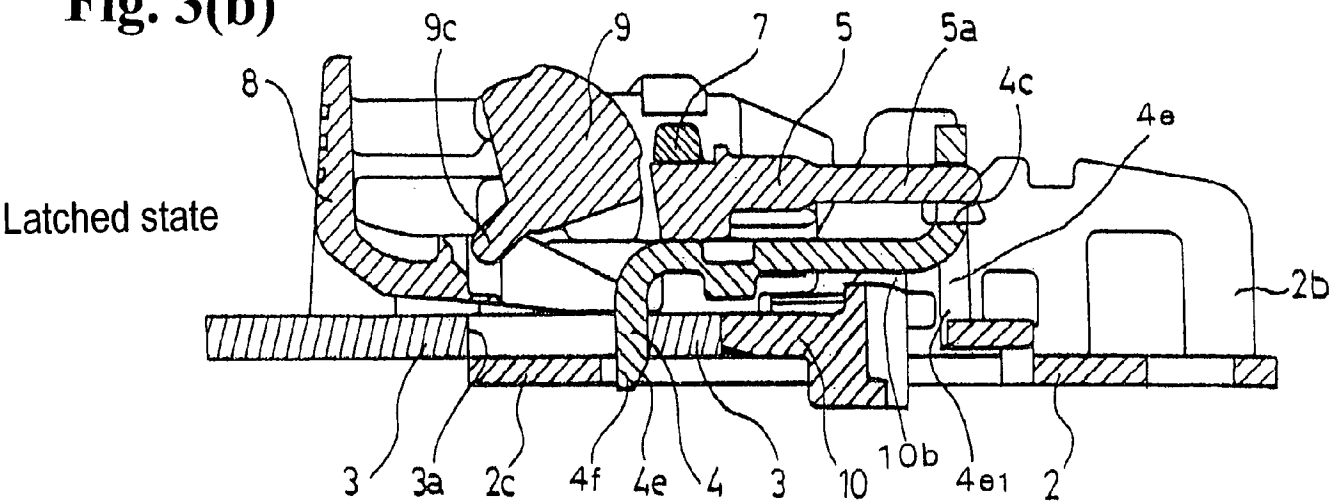

Hereunder, embodiments of the present invention will be described with reference to the accompanying drawings. FIG. 1 is an exploded perspective view of a buckle of a shock-proof device according to an embodiment of the present invention. FIGS. 2(*a*) and 2(*b*) are views showing a release button of the buckle shown in FIG. 1, wherein FIG. 2(*a*) is a perspective view viewed from a direction opposite to that in FIG. 1, and FIG. 2(*b*) is an enlarged view of portion 2(*b*) in FIG. 2(*a*). FIGS. 3(*a*) and 3(*b*) are views showing the buckle shown in FIG. 1, wherein FIG. 3(*a*) is a longitudinal sectional view in a non-latch (disengagement) state to a tongue, and FIG. 3(*b*) is a sectional view showing a latch (engagement) state to the tongue. Note that "upper and lower" used in the description below represent upper and lower portions in each drawing; and "right and left" designate the right and left in FIG. 1 viewing an operation button 8 from a slider 5 while designating the right and left in the other drawings.

As shown in FIGS. 1 to 3(*a*) and 3(*b*), in this embodiment, a buckle 1 includes a base 2 composed of a U-shaped frame having right and left side walls 2*a* and 2*b* and a bottom part 2*c*; a latch member 4 rotatably supported to the side walls 2*a* and 2*b* of the base 2 for being latched to or engaging a tongue 3; a slider 5 supported on the upper surface of the latch member 4 for preventing the movement of the latch member 4 in a latch or engagement release direction during latching or engaging between the tongue 3 and the latch member 4; a slider spring 6 loaded between the slider 5 and the latch member 4 for always urging the slider 5 toward a lock pin 7 (described later); the lock pin 7 supported in holes 2*d* and 2*e* of the side walls 2*a* and 2*b* of the base 2 for pressing (locking) the upper surface of the slider 5 to prevent the movement of the latch member 4 in a latch release direction during latching between the tongue 3 and the latch member 4; a release button 8 arranged on the side walls 2*a* and 2*b* of the base 2 movably in a longitudinal direction; an inertia lever 9 positioned between the release button 8 and the latch member 4 and rotatably supported in grooves 2*f* and 2*g* of the side walls 2*a* and 2*b* of the base 2; an ejector 10 arranged on the bottom part 2*c* of the base 2 slidably in a longitudinal direction of the base 2 for separating the tongue 3 from the buckle 1; and an ejector spring 11 for always urging the ejector 10 in a direction separating the tongue 3 from the buckle 1. The springs 6 and 11 are not shown in FIGS. 3(*a*) and 3(*b*).

The latch member 4 includes rotation shafts 4*a* and 4*b* rotatably supported in support grooves 2*h* and 2*i* formed in the side walls 2*a* and 2*b* of the base 2, respectively. In this case, the latch member 4 is urged clockwise by the spring 6 in a separated (non-latched) state shown in FIG. 3(*a*), and urged clockwise by the ejector spring 11 in a latched state shown in FIG. 3(*b*), so that the latch member 4 are always urged by one of the springs 6 and 11. The latch member 4 also includes a pair of arms 4*d* and 4*e* having pressed parts 4*d*1 and 4*e*1 as respective leading ends extending from the rotation shafts 4*a* and 4*b*, respectively. As described later, the pressed parts 4*d*1 and 4*e*1 can be pressed in the right direction in FIG. 3(*a*) by pressure parts 10*a* and 10*b* (shown in FIG. 1) disposed at the right end of the ejector 10, respectively. Furthermore, the latch member 4 includes a joggling part 4*f* retainable to the tongue 3 and disposed oppositely to the rotation shafts 4*a* and 4*b* and the longitudinal direction of the buckle 1.

The slider 5 includes a projection shaft 5*a* at the center thereof extending in a longitudinal direction of the buckle 1 so as to penetrate a hole 4*c* of the latch member 4. The slider spring 6 is fitted to the projection shaft 5*a*. The slider 5 also includes a pair of right and left engagement shafts 5*b* and 5*c*.

The engagement shafts 5*b* and 5*c* engage and are supported to engagement grooves 2*j* and 2*k* formed in the side walls 2*a* and 2*b* of the base 2 while protruding outside the side walls 2*a* and 2*b* by a predetermined length, respectively. In this case, the engagement grooves 2*j* and 2*k* include first grooves 2*j*1 and 2*k*1 extending in a longitudinal direction of the buckle 1 (movement direction of the release button 8), and second grooves 2*j*2 and 2*k*2 inclined so as to extend and open upwardly from the first grooves 2*j*1 and 2*k*1, respectively. The engagement shafts 5*b* and 5*c* of the slider 5 are movable along the first grooves 2*j*1 and 2*k*1 during a normal operation while being movable along the first grooves 2*j*1 and 2*k*1 and the second grooves 2*j*2 and 2*k*2 during a constrained disengagement, respectively.

In addition, the side walls 2*a* and 2*b* of the buckle 1 including the grooves and the holes formed therein are symmetrical relative to the center line of the buckle 1 in a longitudinal direction.

The release button 8 also includes right and left side walls 8*a* and 8*b* extending in a longitudinal direction of the buckle 1. As shown in FIGS. 1 and 2(*a*), between the side walls 8*a* and 8*b*, right and left projections 8*c* are arranged (one of the projections is shown and the other is not shown; the projections are denoted by 8*c* for the sake of convenience). As shown in FIGS. 2(*a*) and 2(*b*), on internal surfaces opposing each other of the projections 8*c*, there are provided button-side first engagement connection parts (first abutting planes according to the present invention) 8*d*. Each of the button-side first engagement connection parts 8*d* is composed of a vertical plane (perpendicular to the movement direction of the release button; similarly, button-side first engagement connection parts are designated by 8*d*). Also, button-side second engagement connection parts (second abutting planes according to the present invention) 8*e* are provided on internal surfaces opposing each other of the projections 8*c*. Each of the button-side second engagement connection parts 8*e* is composed of a plane inclined relative to the vertical plane (similarly, button-side second engagement connection parts are designated by 8*e*). An inclination of the button-side second engagement connection part 8*e* will be described later.

As shown in FIG. 1, on internal surfaces of the side walls 8*a* and 8*b*, there are provided pressing parts 8*f* (similarly, pressing parts are designated by 8*f*), each composed of a vertical plane and moving in a release direction so as to press each of the engagement shafts 5*b* and 5*c* when the release button 8 is moved in the release direction. In addition, the side walls 8*a* and 8*b* of the release button are symmetrical relative to the center line of the buckle 1 in a longitudinal direction.

The inertia lever 9 is provided with a pair of right and left rotation shafts 9*a* and 9*b* rotatably fitted into the grooves 2*f* and 2*g* in the side walls 2*a* and 2*b* of the base 2, respectively. The inertia lever 9 also includes a round pin-shaped lever-side engagement connection part 9*c* with a circular cross-section. One end of the lever-side engagement connection part 9*c* abuts against the button-side first and second engagement connection parts 8*d* and 8*e* at the right side while the other end abuts against the button-side first and second engagement connection parts 8*d* and 8*e* at the left side, so that the inertia lever 9 is connected to be relatively rotatable. In this case, as shown in FIGS. 4 and 5, the inclination of the button-side second engagement connection part 8*e* is a slope along a straight line β connecting between the portions abutting against the lever-side engagement connection part 9*c* and the centers of the rotation shafts 9*a* and 9*b* of the inertia lever 9 located at the upper right of the abutting portions (upwardly in the release direction of the release button 8).

Figure 4:
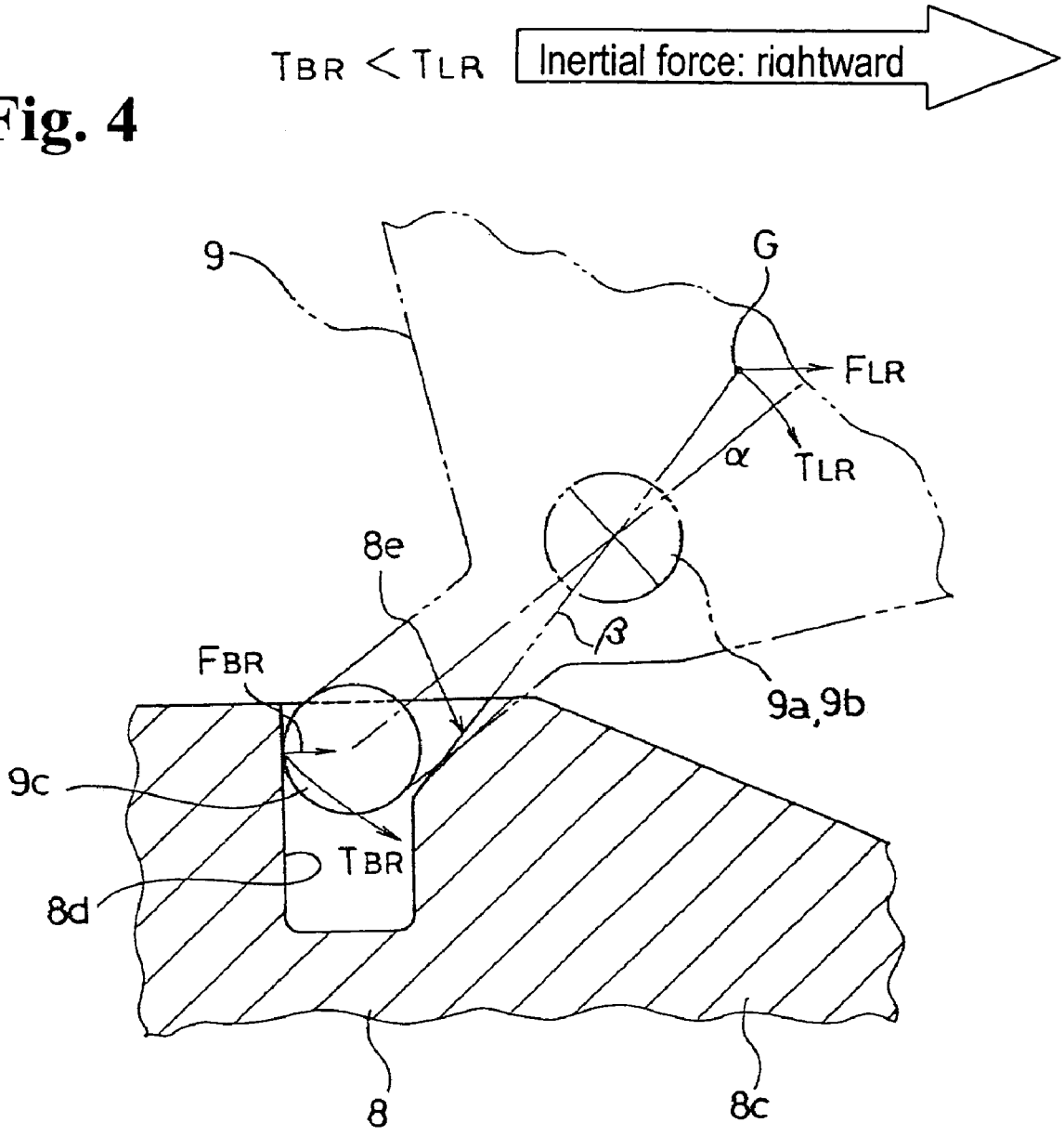
FIG. 4 is a view showing an action of the release button and an inertia lever when an inertial force is applied in a release direction of the buckle shown in FIG. 1.
Figure 5:
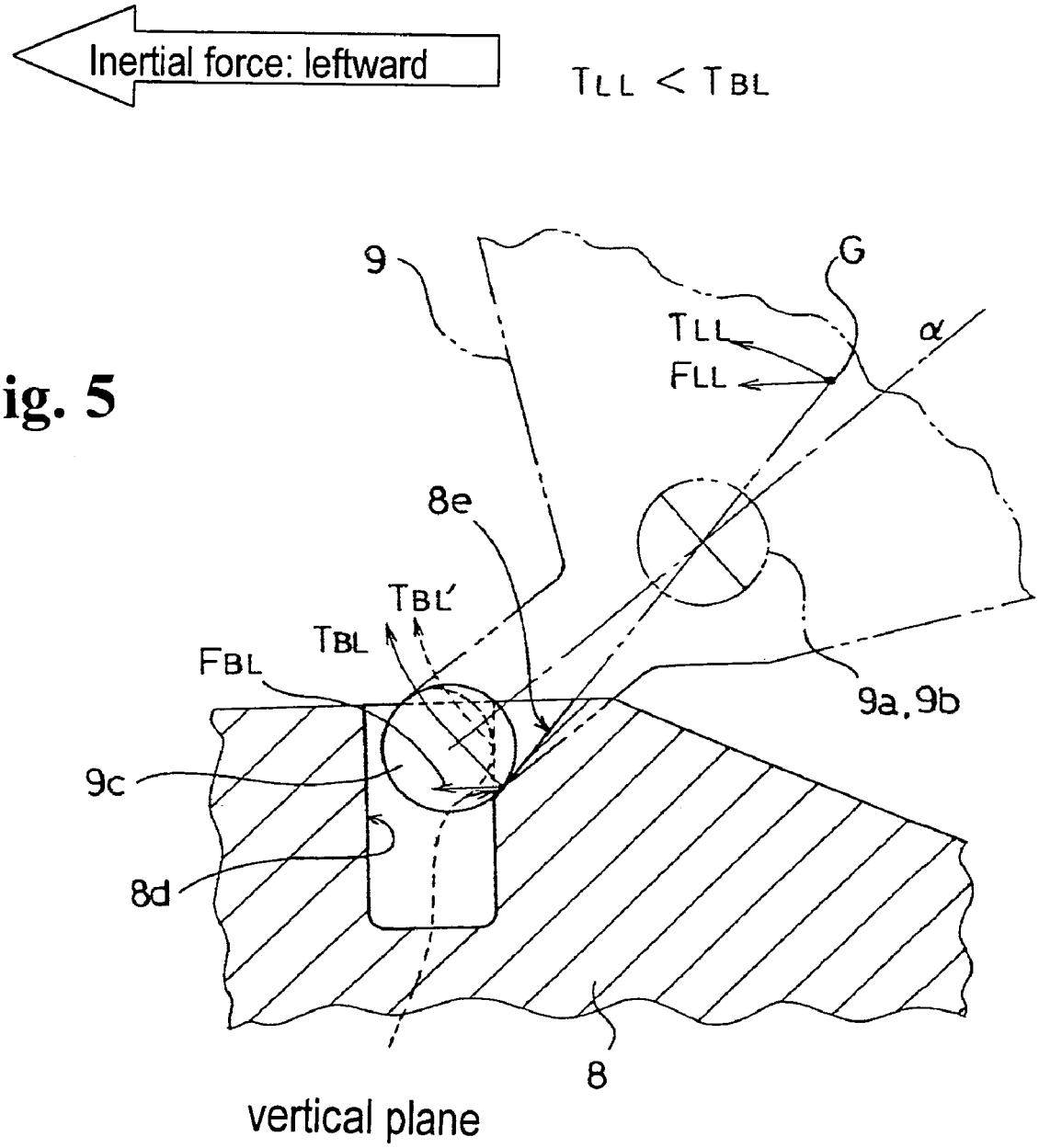
FIG. 5 is a view showing an action of the release button and the inertia lever when an inertial force is applied in a non-release direction of the buckle shown in FIG. 1.

As shown in FIGS. 4 and 5, the center of gravity G of the inertia lever 9 is established at a position opposite to the lever-side engagement connection part 9*c* about against the rotation shafts 9*a* and 9*b*, and slightly upper than a straight line a connecting between the centers of the rotation shafts 9*a* and 9*b* and the center of the lever-side engagement connection part 9*c* (in this example, the center of gravity G is set on an extension of the straight line β).

Next, a torque applied to the inertia lever 9 when inertia is applied to the buckle 1 of this embodiment in right and left directions as well as a difference in the torques established in the buckle 1 will be described. First, as shown in FIG. 4, a case where the inertia is applied to the buckle 1 in a rightward direction (in a release direction of the release button 8) will be described. In this case, by a rightward lever inertial force FLR, a clockwise torque TLR of the inertia lever itself is applied to the inertia lever 9. By the torque TLR, the inertia lever 9 is rotated clockwise while by a rightward button inertial force FBR, the release button 8 is moved to the right. Then, the lever-side engagement connection part 9*c* immediately engages the vertical planes of the button-side first engagement connection parts 8*d*. Since the lever-side engagement connection part 9*c* is thereby pressed by the button inertial force FBR of the release button 8, a torque TBR due to a counterclockwise button inertial force FBR is applied to the inertia lever 9. In this case, the torques TLR and TBR are set to be TBR<TLR.

A case where the inertia is applied to the buckle 1 in a leftward direction (in a non-release direction of the release button 8) will be described as shown in FIG. 5. In this case, by a leftward inertial force FLL of the lever, a counterclockwise torque TLL of the inertia lever itself is applied to the inertia lever 9. By the torque TLL, the inertia lever 9 is rotated counterclockwise while by a leftward button inertial force FBL, the release button 8 is moved to the left. Then, the lever-side engagement connection part 9*c* immediately engages the inclined planes of the button-side second engagement connection parts 8*e*. Since the lever-side engagement connection part 9*c* is thereby pressed by the button inertial force FBL of the release button 8, a torque TBL due to a counterclockwise button inertial force FBL is applied to the inertia lever 9. In this case, the torques TLL and TBL are set to be TLL<TBL.

In the same way as that shown in FIG. 5, under a normal condition, the lever-side engagement connection part 9*c* of the inertia lever 9 abuts against the inclined planes of the button-side second engagement connection parts 8*e*. The vertical planes of the button-side first engagement connection parts 8*d* and the inclined planes of the button-side second engagement connection parts 8*e* constitute torque-difference generating mechanism according to the present invention.

Next, an operation of latching the buckle 1 with the tongue 3 constructed in such a manner will be described. In a non-latch state of the buckle 1 into which the tongue 3 is not inserted, as shown in FIG. 3(*a*), the ejector 10 is set at the left limited position by a spring force of the ejector spring 11. At the left limited position of the ejector 10, the latch member 4 is rotated upwardly (clockwise from the latch state) on account of the slider 5, the lock pin 7, and the slider spring 6. At this time, the slider 5 comes off the lock pin 7 so as to be located at an upward-rotated position, and the upper surface of the latch member 4 abuts against the bottom surface of the lock pin 7. In this state, the joggling part 4*f* deviates from an insertion path of the tongue 3 so that the latch member 4 is set at a non-latch position at which the latch member 4 is not latched with the tongue 3. The right and left ends of the lever-side engagement connection part 9*c* of the inertia lever 9 are located between the button-side first and second engagement connection parts 8*d* and 8*e* at the right and left sides.

When the tongue 3 is inserted into a tongue insertion inlet 1*a* at the left end of the buckle 1 from the non-latch state of the buckle 1 shown in FIG. 3(*a*), the right end of the tongue 3 abuts against the left end of the ejector 10 so as to press the ejector 10 to the right. Then, the ejector 10 is moved rightward to compress the ejector spring 11 in accordance with the insertion of the tongue 3, so that pressing parts 10*a* and 10*b* of the ejector 10 press pressed parts 4*d*1 and 4*e*1 rightward so as to rotate the latch member 4 downwardly (counterclockwise). Thereby, the joggling part 4*f* of the latch member 4 enters a movement path of the tongue 3 so as to fit into an engaging hole 3*a* of the tongue 3 and locate the latch member 4 at a latch position. Then, when an insertion force of the tongue 3 is cancelled, by a spring force of the ejector spring 11, the ejector 10 presses the right end of the tongue 3 so that the right end of the engaging hole 3*a* of the tongue 3 engages the joggling part 4*f*. Accordingly, the tongue 3 is latched with the buckle 1 so as to become a latch state between the tongue 3 and the buckle 1 shown in FIG. 3(*b*).

At this time, by a spring force of the slider spring 6, the slider 5 enters a position below the lock pin 7 so that the upper surface of the slider 5 is pressed by the lock pin 7. Since the slider 5 thereby maintains the latch member 4 at the latch position shown FIG. 3(*b*), the latch member 4 does not come off the engaging hole 3*a* of the tongue 3 so that the latch between the tongue 3 and the buckle 1 is firmly held.

When the release button 8 is pushed to the right for canceling the latch between the tongue 3 and the buckle 1 from the latched state shown in FIG. 3(*b*), the release button 8 moves to the right. The pressing parts 8*f* of the release button 8 press the engagement shafts 5*b* and 5*c* of the slider 5 rightward so that the slider 5 moves to the right relative to the latch member 4 against the urging force of the slider spring 6. Then, the engagement shafts 5*b* and 5*c* of the slider 5 are separated from first grooves 2*j*1 and 2*k*1 while the upper left end of the slider 5 comes off the bottom surface of the lock pin 7, so that the slider 5 is not pressed by the lock pin 7.

Then, the slider 5 and the latch member 4 are rotated clockwise, and the joggling part 4*f* is moved upwardly. Since the ejector 10 is urged in a latch-release direction by a spring force of the ejector spring 11, the ejector 10 strikes the latch member 4 upwardly via the tongue 3 so as to further rotate the latch member 4 and the slider 5 clockwise about the rotation shafts 4*a* and 4*b*, so that the tongue 3 is pushed out to the left and the joggling part 4*f* is separated from the engaging hole 3*a* of the tongue 3.

As shown in FIG. 3(*a*), when the upper surface of the latch member 4 adjacent to the joggling part 4*f* abuts against the lock pin 7, the clockwise rotation of the latch member 4 and the slider 5 is stopped. At this time, the left end of the slider 5 abuts against the lock pin 7 by the urging force of the slider spring 6. Finally, the ejector 10 is located at the left limited position; the latch member 4 is located at a non-latch position; and the buckle 1 becomes a non-latch state separated from the tongue 3.

In a state that the tongue 3 is inserted into and engaged with the buckle 1, an inertial force is applied to the release button 8 of the buckle 1 when:

(1) an emergency locking retractor (ELR) (not shown) withdraws a seatbelt with a pre-tensioner (not shown) at an emergency, for example, and the buckle 1 is rapidly pulled toward the retractor, so that as shown in FIG. 4, the inertial force is applied to the release button 8 and the inertia lever 9 rightward (in a release direction of the release button 8). Then, when the seatbelt is withdrawn to the bottom, the buckle 1 is rapidly stopped so that as shown in FIG. 5, the inertial force is applied to the release button 8 and the inertia lever 9 leftward (in the non-release direction of the release button 8).

(2) a back pre-tensioner from BKC Industries, Inc. (BKC-PT) (not shown) at an emergency, for example, rapidly pulls the buckle 1 toward a vehicle body, so that as shown in FIG. 5, the inertial force is applied to the release button 8 and the inertia lever 9 leftward (in the non-release direction of the release button 8). Then, when the buckle 1 is pulled to the bottom, the buckle 1 is rapidly stopped so that as shown in FIG. 4, the inertial force is applied to the release button 8 and the inertia lever 9 rightward (in the release direction of the release button 8).

In the case of (1), as shown in FIG. 4, first, the clockwise torque TLR of the inertia lever itself is applied to the inertia lever 9 by the rightward lever inertial force FLR as described above. The vertical planes of the lever-side engagement connection part 9*c* and the button-side first engagement connection part 8*d* engage each other so that the torque TBR due to the counterclockwise button inertial force FBR is applied to the inertia lever 9. At this time, because the torques TLR and TBR are set to be TBR<TLR, the inertia lever 9 is to rotate clockwise, not counterclockwise. Accordingly, the release button 8 is securely prevented from moving in the release direction, so that the buckle 1 and the tongue 3 are firmly held together.

Afterward, when the buckle 1 is rapidly stopped because the seatbelt is pulled to the bottom, as shown in FIG. 5, the counterclockwise torque TLL of the inertia lever itself is applied to the inertia lever by the leftward lever inertial force FLL 9 as described above. The inclined planes of the lever-side engagement connection part 9*c* and the button-side second engagement connection part 8*e* engage each other so that the torque TBL due to the clockwise button inertial force FBL is applied to the inertia lever 9. In this case, the lever-side engagement connection part 9*c* receives the button inertial force FBL via the inclined plane of the button-side second engagement connection part 8*e*. Because the inclined plane is a slope along the line β connecting between the parts abutting against the lever-side engagement connection part 9*c* (i.e., points of application of force) and the centers of the rotation shafts 9*a* and 9*b*, a force from the release button 8 is applied to the lever-side engagement connection part 9*c* substantially perpendicularly to the inclined plane.

At this time, the inertia lever 9 rotates counterclockwise so as to move the release button 8 in the release direction via the lever-side engagement connection part 9*c*. However, because the torques TLL and TBL are set to be TLL<TBL, when the release button 8 is urged by the inertia lever 9 in the release direction, the release button 8 moves in the release direction. If the inertial force FBL is applied in the release direction, the movement is securely prevented by the release button itself. Thus, the movement of the release button 8 in the release direction is certainly prevented so that the latch between the buckle 1 and the tongue 3 is reliably maintained.

A force from the release button 8 is applied to the lever-side engagement connection part 9*c* perpendicularly to the inclined plane, so that the force from the release button 8 is applied more effectively. In this case, the torque TBL due to the button inertial force FBL becomes larger than that when the lever-side engagement connection part 9*c* abuts against the vertical plane indicated by a hidden line as usual. Consequently, the latch between the buckle 1 and the tongue 3 is more securely maintained as compared with the above-mentioned conventional buckle 1.

While the inertia lever 9 is prevented from moving the release button 8 in the release direction against the rightward inertial force shown in FIG. 4, in order to prevent the inertia lever 9 from moving the release button 8 in the release direction against the leftward inertial force, when the lever-side engagement connection part 9*c* abuts against the vertical plane in any direction, the torques must be TLR≈TBR and TLL≈TBL in a conventional case. Accordingly, the movement prevention of the release button 8 in the release direction becomes unstable.

In the case of (2), the buckle 1 is first pulled and is rapidly stopped after the buckle 1 reaches the bottom, so that the inertial force applied to the release button 8 of the buckle 1 and the inertia lever 9 is reversed. That is, the inertial force shown in FIG. 5 is applied to the release button 8 and the inertia lever 9, and then, the inertial force shown in FIG. 4 is applied to the release button 8 and the inertia lever 9. Thus, also in the case of (2), in the release and non-release directions of the release button 8, the latch between the buckle 1 and the tongue 3 is more reliably maintained than that of the conventional buckle 1 described above in the same way as in the case of (1) mentioned above.

In such a manner, according to the buckle 1 of this embodiment, in the button inertial force FBR in the release direction of the release button 8, a torque applied to the inertia lever 9 by the button inertial force FBR is set smaller while in the button inertial force FBL in the non-release direction of the release button 8, a torque applied to the inertia lever 9 by the button inertial force FBL is set larger, so that a torque difference is set in the inertia lever 9 according to the direction of the inertial force applied to the release button 8. Thus, when the inertial force is applied in either of the release and non-release directions of the release button 8, the latch between the buckle 1 and the tongue 3 can be more reliably maintained. Moreover, the torque-difference generating mechanism is structured by the inclined plane of the release button 8, thereby making the structure simple.

The buckle 1 having the shock-proof device according to the present embodiment may be used in a conventional and known seatbelt apparatus. In the seatbelt apparatus having the buckle 1, even when an inertial force is applied to the buckle in the release direction, an occupant sitting on a vehicle seat can be restrained and protected more reliably.

The center of gravity G of the inertia lever 9 is set on the extension of the straight line β. However, the present invention is not limited to this arrangement, and it may be set at any position as far as it is in the vicinity thereof. Also, in the buckle 1 of this embodiment, when the lever inertial force FT is applied to the buckle 1 in a direction perpendicular to the movement direction of the release button 8, the inertia lever 9 oscillates. The position of the center of gravity, the mass, and the point of application to the release button 8 of the inertia lever 9 are arranged so as not to move the release button 8 to a position releasing the latch of the latch member 4 by the oscillation.

Furthermore, in this embodiment, the above-mentioned inclined plane is a slope along the straight line β connecting the abutting portions between the lever-side engagement connection part 9*c* and the button-side second engagement connection part 8*e* to the rotation shafts 9*a* and 9*b*. However, the present invention is not limited to this arrangement, and any inclined plane may be applied as far as it is ascending in the release direction of the release button 8. However, it is preferable that the inclined plane be a slope along the straight line β as in the embodiment, because the moment due to the inertial force can be efficiently generated.

Moreover, in this embodiment, the button-side first engagement connection part 8*d* is the vertical plane while the button-side second engagement connection part 8*e* is the inclined plane. However, the present invention is not limited to this arrangement, and the button-side first engagement connection part 8*d* may be an inclined plane while the button-side second engagement connection part 8*e* may be a vertical plane. Also, both the button-side first and second engagement connection parts 8*d* and 8*e* may be inclined planes. In this case, the inclined plane must set a torque difference in the inertia lever 9 according to the direction of the inertial force applied to the release button 8, as described above.

Figure 6:
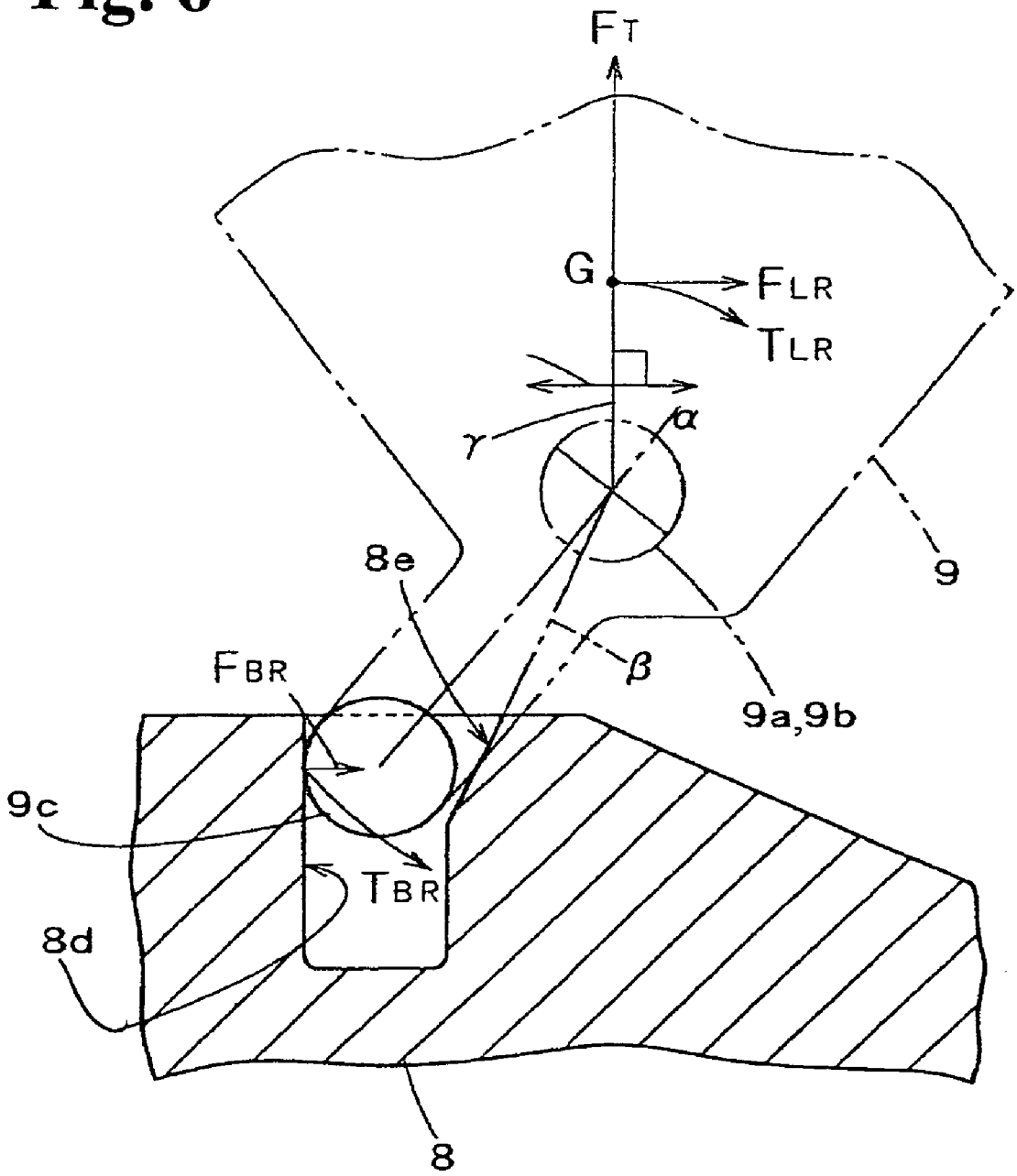
FIG. 6 is a schematic view showing a part of a buckle according to another embodiment of the present invention.

FIG. 6 is a schematic view showing a part of a buckle according to another embodiment of the present invention. In the description of the embodiment below, the same reference numerals designate the same components in the previous embodiment, and the detailed description is omitted.

In the previous embodiment, the center of gravity G of the inertia lever 9 is set on the extension of the straight line β or at a position in the vicinity thereof. In the buckle 1 in this embodiment, as shown in FIG. 6, the center of gravity G of the inertia lever 9 is set on a straight line γ passing through the rotation shafts 9*a* and 9*b* and being perpendicular to the movement direction of the release button 8. By setting the position of the center of gravity G of the inertia lever 9 in such a manner, when the lever inertial force FT is applied to the buckle 1 in a direction perpendicular to the movement direction of the buckle 1, a torque due to the lever inertial force FT is not generated in the inertia lever 9. Thus, even when the lever inertial force FT is applied to the buckle 1, the inertia lever 9 can be prevented from oscillating. Thereby, while the lever inertial force FT is applied to the buckle 1, the release button 8 does not move in the release direction, and the movement of the release button 8 in the release direction due to the oscillatory motion of the inertia lever 9 can be securely prevented.

Other structures and operational effects of the buckle 1 in this embodiment are the same as those of the previous embodiment.

Figure 7A:
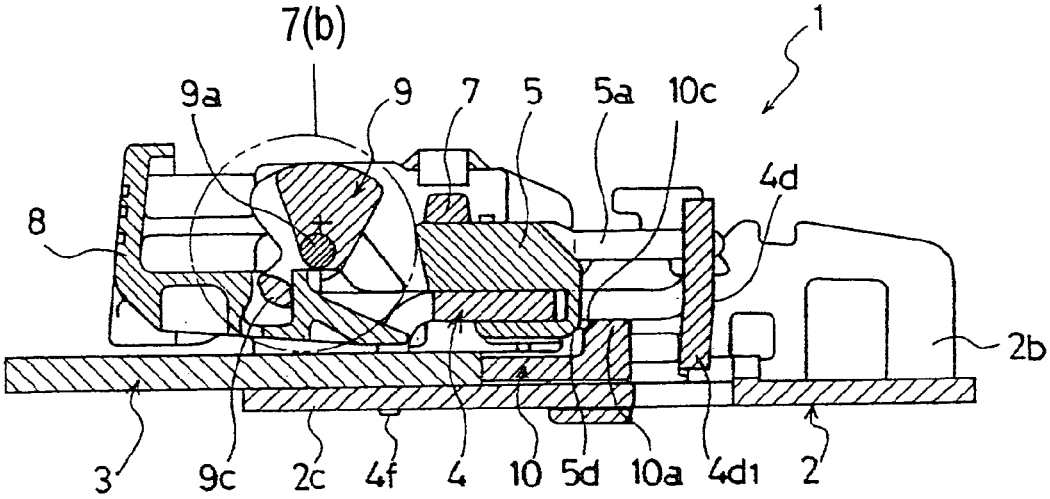
FIGS. 7(*a*) and 7(*b*) are views showing a buckle according to a further embodiment of the present invention, wherein FIG. 7(*a*) is a longitudinal sectional view of the buckle taken along a line passing through button-side first and second engagement connection parts adjacent to a left side wall of a base, and FIG. 7(*b*) is a partially enlarged view of a portion 7(*b*) in FIG. 7(*a*)
Figure 7B:
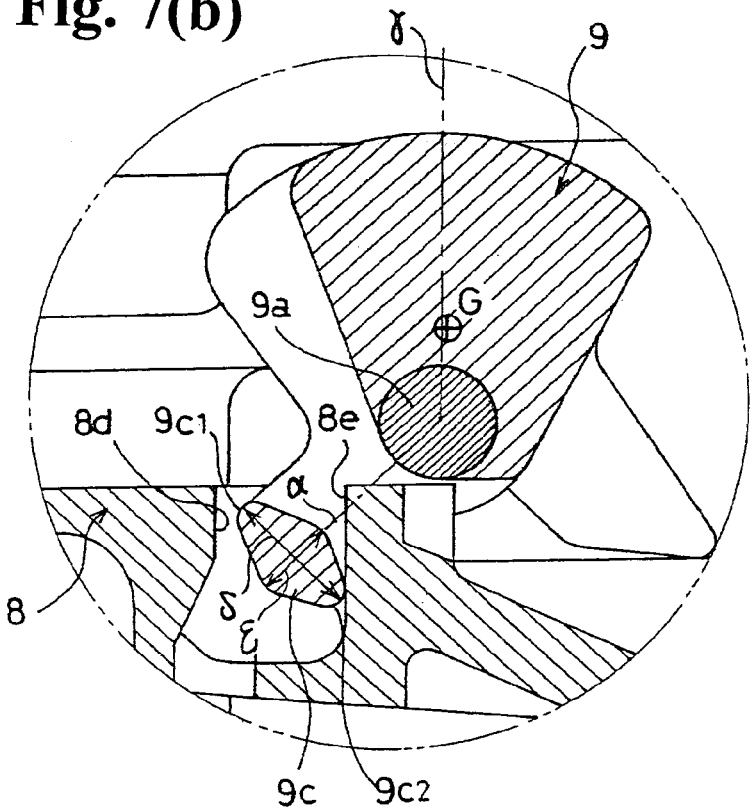

FIGS. 7(*a*) and 7(*b*) are views showing a buckle according to a further embodiment of the present invention. FIG. 7(*a*) is a longitudinal sectional view of the buckle taken along a line passing through button-side first and second engagement connection parts adjacent to a left side wall of a base, and FIG. 7(*b*) is a partially enlarged view of a portion 7(*b*) in FIG. 7(*a*).

In the embodiments described above, the lever-side engagement connection part 9*c* of the inertia lever 9 is formed in a round-pin shape with a circular cross-section while the button-side second engagement connection part 8*e* is formed in an inclined plane. As shown in FIGS. 7(*a*) and 7(*b*), in the buckle 1 in this embodiment, the lever-side engagement connection part 9*c* of the inertia lever 9 has a rhombus cross-section with rounded four corners while the button-side second engagement connection part 8*e* is formed in a vertical (perpendicular to the movement direction of the release button 8) plane in the same way as in the button-side first engagement connection part 8*d*.

In the lever-side engagement connection part 9*c* with the rhombus cross-section, a major axis δ thereof perpendicularly intersects the straight line α connecting the center of the lever-side engagement connection part 9*c* to the centers of the rotation shafts 9*a* and 9*b* while an extension of a minor axis ϵ thereof passes through the both rotation shafts 9*a* and 9*b*. The extension is aligned with the straight line α connecting the center of the lever-side engagement connection part 9*c* to the centers of the both rotation shafts 9*a* and 9*b*. The lever-side engagement connection part 9*c*, therefore, has a slender cross section extending in a direction perpendicular to the straight line α.

First and second ends 9*c*1 and 9*c*2 of the lever-side engagement connection part 9*c* formed along the major axis δ can abut against the opposing button-side first and second engagement connection parts 8*d* and 8*e*, respectively. As shown in FIG. 7(*b*), the center of gravity G of the inertia lever 9 is set at a position in the vicinity of the straight line γ passing through the rotation shafts 9*a* and 9*b* and being perpendicular to the movement direction of the release button 8 in substantially the same way as in the embodiment shown in FIG. 6, so that the second end 9*c*2 abuts against the button-side second engagement connection part 8*e* in a state that an inertial force is not applied to the buckle 1.

The torque-difference generating mechanism in this embodiment is arranged such that the lever-side engagement connection part 9*c* is formed in a slender shape with a rhombus cross-section as mentioned above. Accordingly, a length of perpendicular to a line of action ξ of the button inertial force FBR applied to the inertia lever 9 in the release direction from the centers of the rotation shafts 9*a* and 9*b* is smaller than a length of perpendicular to a line of action η of the button inertial force FBL applied to the inertia lever 9 in the non-release direction from the centers of the rotation shafts 9*a* and 9*b*.

Furthermore, as shown in FIG. 7(*a*), the slider 5 is provided with a slider-side abutting part 5*d* formed thereon and composed of an inclined plane (inclined downwardly in the movement direction of the release button 8) capable of abutting against the release button 8. The ejector 10 is provided with an ejector-side abutting part 10*c* formed thereon and composed of an inclined plane (inclined upwardly in the movement direction of the release button 8) capable of abutting against the slider-side abutting part 5*d*.

In order to separate the tongue 3 from the latch state of the buckle 1 shown in FIG. 7(*a*), if the release button 8 is moved in the release direction (rightward in the drawing), the slider 5 moves rightward in the same way as in the previous embodiment, so that the slider-side abutting part 5*d* abuts against the ejector-side abutting part 10*c*. Then, the ejector 10 moves rightward to compress the ejector spring 11 so as to be separated from the right end of the tongue 3.

When the slider-side abutting part 5*d* abuts against the ejector-side abutting part 10*c* to compress the ejector spring 11, the ejector 10 presses the slider 5 upwardly to the left in the drawing by the spring force of the ejector spring 11. The latch member 4 is, therefore, rotated in the non-release direction (clockwise) so as to cancel the engagement between the tongue 3 and the latch member 4, so that the tongue 3 is pushed out of the buckle 1 by the ejector 10.

Since the separating operation between the buckle 1 and the tongue 3 is not directly related to the present invention, more detailed description is omitted. Other structures of the buckle 1 in this embodiment are the same as those in the previous embodiments.

Figure 8:
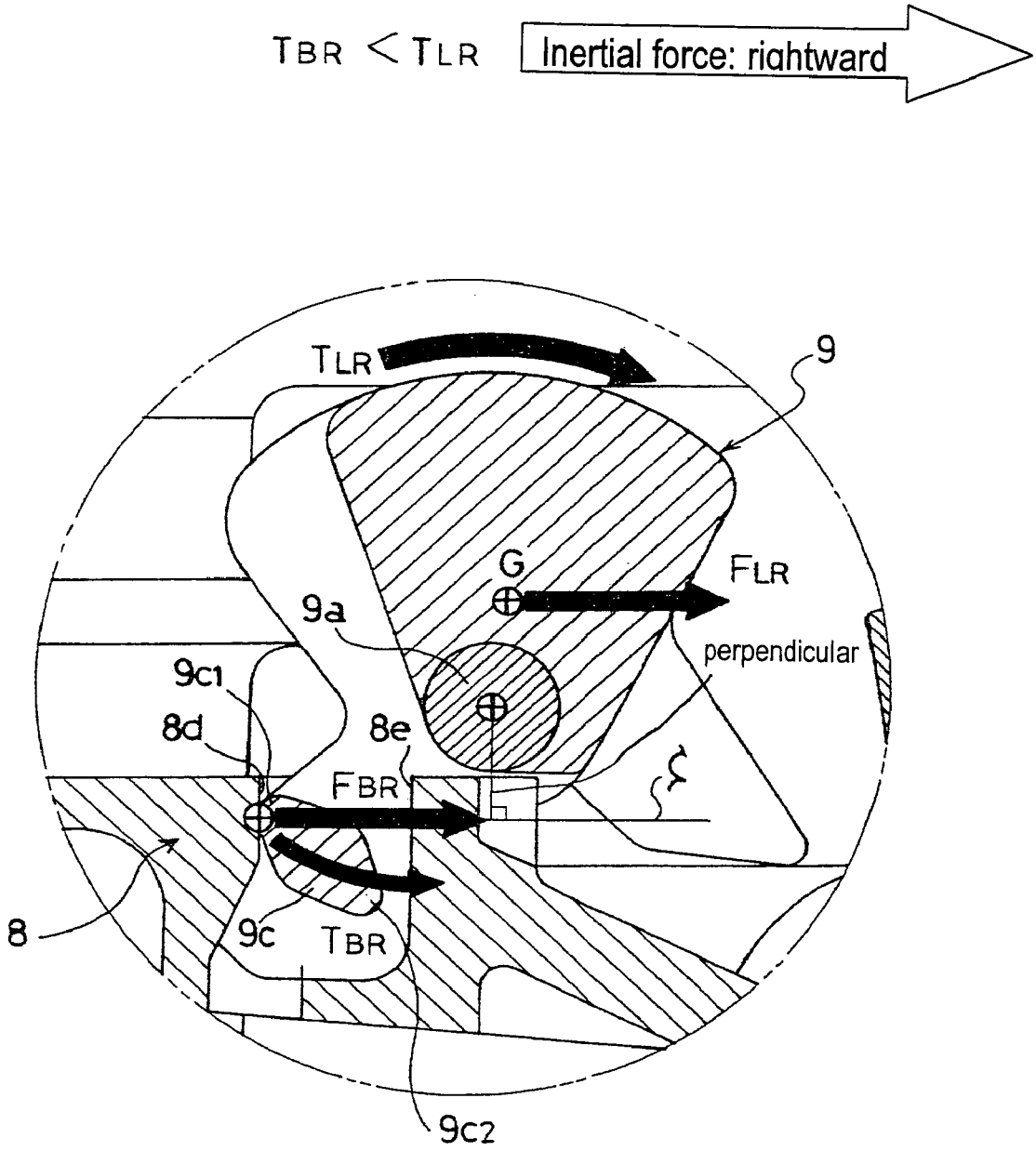
FIG. 8 is a view showing an action of a release button and an inertia lever when an inertial force is applied in a release direction of the buckle shown in FIG. 7(*a*)

In the buckle 1 structured as above in this embodiment, a case that the release button 8 of the buckle 1 receives an inertial force in the release direction in a state that the tongue 3 is inserted into and engages the buckle 1 will be described. When the inertial force is applied to the buckle 1 as in the above-mentioned case of (1), as shown in FIG. 8, first, the clockwise torque TLR of the inertia lever itself due to the rightward lever inertial force FLR is applied to the inertia lever 9 in the same way as in the previous embodiments. Accordingly, the inertia lever 9 is rotated clockwise while the release button 8 is moved by the rightward button inertial force FBR. Then, the first end 9*c*1 of the lever-side engagement connection part 9*c* immediately engages the vertical plane of the button-side first engagement connection part 8*d*. Thereby, the lever-side engagement connection part 9*c* is pressed by the button inertial force FBR of the release button 8, so that the torque TBR due to the counterclockwise button inertial force FBR is applied to the inertia lever 9. Since the torques TLR and TBR are set to be TBR<TLR at this time, the inertia lever 9 rotates only clockwise and does not rotate counterclockwise. Thus, the release button 8 is securely prevented from moving in the release direction, so that the latch between the buckle 1 and the tongue 3 can be reliably maintained.

Afterward, when the buckle 1 is rapidly stopped because the seatbelt is withdrawn to the bottom, as shown in FIG. 9, the counterclockwise torque TLL of the inertia lever itself is applied to the inertia lever 9 by the leftward lever inertial force FLL, so that the inertia lever 9 rotates counterclockwise while the release button 8 is moved leftward by the leftward button inertial force FBL. Then, the second end 9*c*2 of the lever-side engagement connection part 9*c* immediately engages the vertical plane of the button-side second engagement connection part 8*e*. Thereby, the lever-side engagement connection part 9*c* is pressed by the button inertial force FBL of the release button 8, so that the torque TBL due to the clockwise button inertial force FBL is applied to the inertia lever 9. Since the torques TLL and TBL are set to be TLL<TBL at this time, the release button 8 is securely prevented from moving in the release direction by,the button inertial force FBL in the non-release direction, so that the latch between the buckle 1 and the tongue 3 can be reliably maintained.

In this case, a force from the release button 8 is applied to the second end 9*c*2 of the lever-side engagement connection part 9*c* perpendicularly to the vertical plane of the button-side second engagement connection part 8*e*. Since the cross-section of the lever-side engagement connection part 9*c* is elongated in a direction perpendicular to the straight line $\alpha$ at this time, a length of perpendicular to a line of action $\eta$ of a force applied to the second end 9*c*2 from the center of the rotation shaft 9*a* of the inertia lever 9 becomes larger than that in the case that the lever-side engagement connection part 9*c* with a circular cross-section as in a conventional one abuts against the vertical plane of the button-side second engagement connection part 8*e* (in the conventional lever-side engagement connection part 9*c* with a circular cross-section, a length of perpendicular to a line of action of a force is substantially the same as the length of perpendicular $\xi$ when the second end 9*c*1 of the lever-side engagement connection part 9*c* abuts against the vertical plane of the button-side first engagement connection part 8*d*). Accordingly, the torque TBL due to the button inertial force FBL becomes larger, so that the latch between the buckle 1 and the tongue 3 can be more reliably maintained. Other operational effects of the buckle 1 in this embodiment are the same as those of the previous embodiments.

In order to prevent the inertia lever 9 from moving the release button 8 in the release direction against a leftward inertial force while preventing the inertia lever 9 from moving the release button 8 in the release direction against the rightward inertial force shown in FIG. 8, when the conventional lever-side engagement connection part 9*c* with a circular cross-section abuts against the vertical plane in any direction, the torques must be set to be TLR≈TBR and TLL≈TBL. Accordingly, the prevention of the movement of the release button 8 in the release direction becomes unstable.

In the case of (2), the buckle 1 is first pulled and is rapidly stopped after the buckle 1 reaches the bottom, so that the inertial force applied to the release button 8 of the buckle 1 and the inertia lever 9 is reversed. That is, the inertial force shown in FIG. 9 is applied to the release button 8 and the inertia lever 9 at first, and then, the inertial force shown in FIG. 8 is applied to the release button 8 and the inertia lever 9. Thus, also in the case of (2), in the release and non-release directions of the release button 8, the latch between the buckle 1 and the tongue 3 is more reliably maintained than that of the conventional buckle 1 described above in the same way as in the case of (1) mentioned above.

In the buckle 1 in this embodiment, the torque-difference generating mechanism is arranged such that a length of perpendicular to a line of action of the inertial force FBR applied to the inertia lever 9 in the release direction from the centers of the rotation shafts 9*a* and 9*b* is smaller than a line of action of the button inertial force FBL applied to the inertia lever 9 in the non-release direction from the centers of the rotation shafts 9*a* and 9*b*. Thereby, the torque difference can be established in the inertia lever 9 according to the direction of the inertial force applied to the release button 8 in the same way as in the previous embodiments.

The torque-difference generating mechanism is formed of the lever-side engagement connection part 9*c* with a simple rhombus cross-section of the inertia lever 9. Accordingly, the button-side first and second engagement connection parts 8*d* and 8*e* of the release button 8 can be formed in simple vertical planes. Thereby, the torque-difference generating mechanism has a simple structure while the processing of the button-side first and second engagement connection parts 8*d* and 8*e* is easy, and the difference in the lengths of perpendiculars described above can be simply established.

In the buckle 1 in the embodiment shown in FIGS. 7(*a*) and 7(*b*), the cross-section of the lever-side engagement connection part 9*c* is a rhombus with the major axis $\delta$ perpendicular to the straight line $\alpha$. However, the present invention is not limited to this arrangement, and the cross-section of the lever-side engagement connection part 9*c* may have a different shape such as an oblong, an oval, and a slender parallelogram, as far as it has a slender shape perpendicular to the straight line $\alpha$.

Figure 10A:
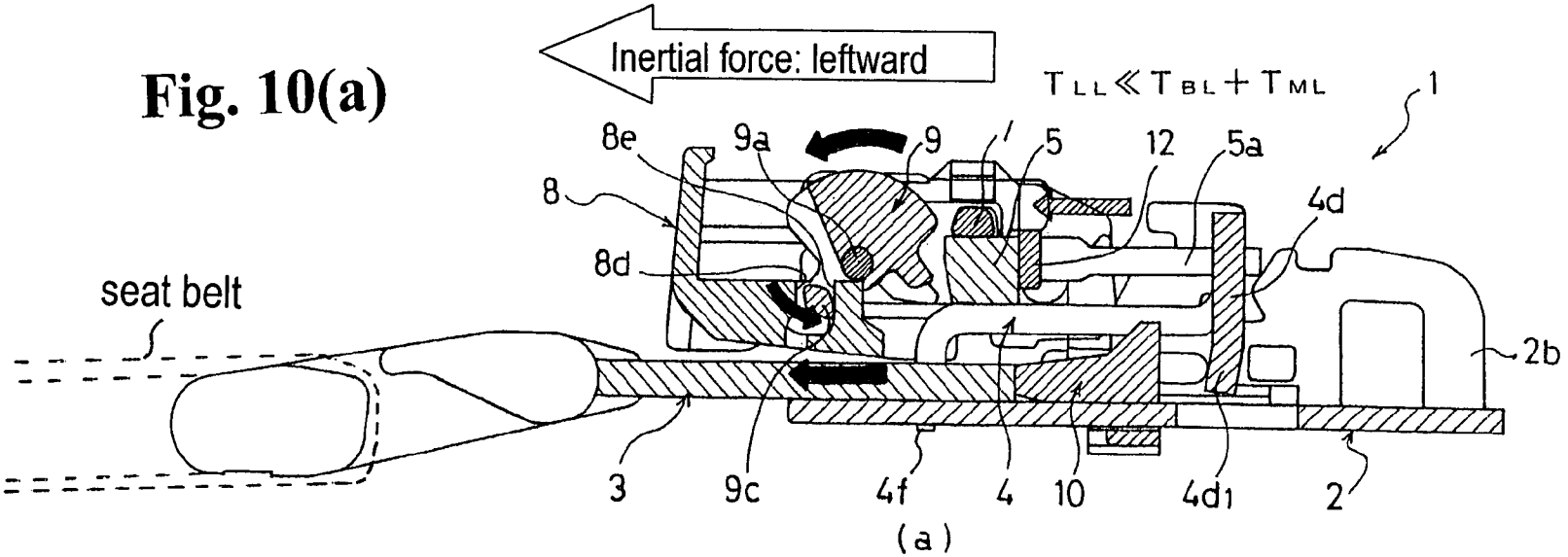
FIGS. 10(*a*) and 10(*b*) are views showing a buckle according to a still further embodiment of the present invention, wherein FIG. 10(*a*) is a sectional view showing an action of a release button and an inertia lever when an inertial force is applied in a non-release direction of the buckle, and FIG. 10(*b*) is a sectional view showing an action of the release button and the inertia lever when an inertial force is applied in the release direction of the buckle.
Figure 10B:
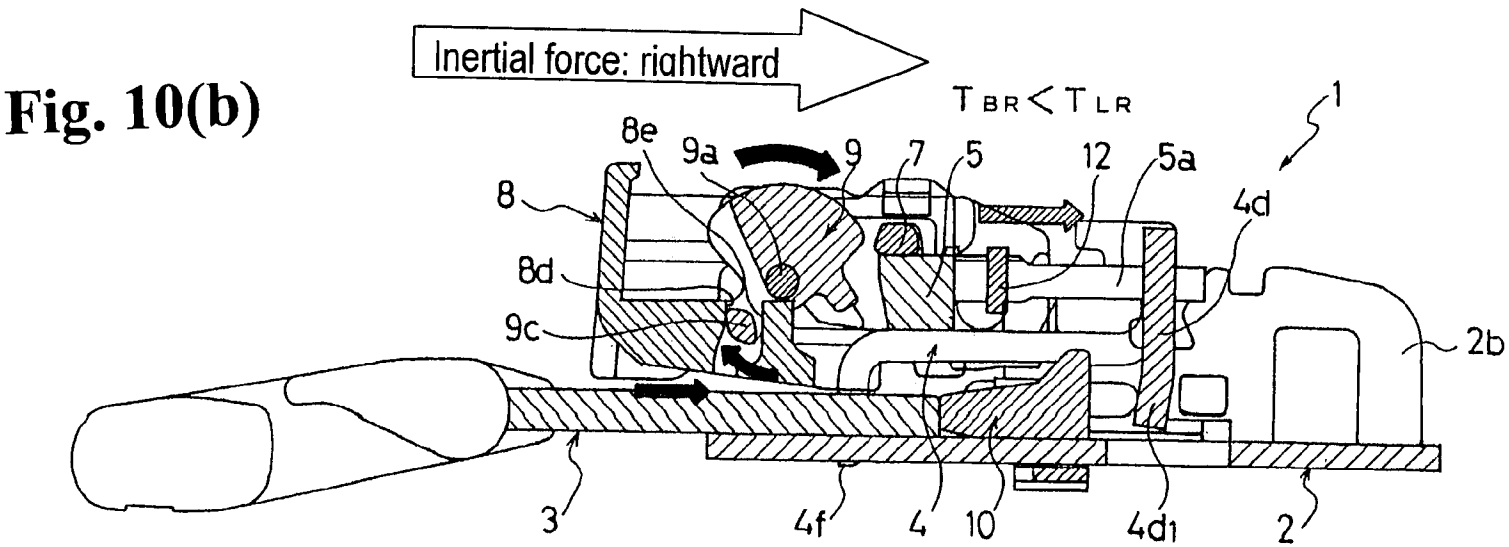

FIGS. 10(*a*) and 10(*b*) are views showing a buckle according to a still further embodiment of the present invention, wherein FIG. 10(*a*) is a view showing an action of a release button and an inertia lever when an inertial force is applied in a non-release direction of the buckle (leftward in the drawing), and FIG. 10(*b*) is a view showing an action of the release button and the inertia lever when an inertial force is applied in the release direction of the buckle (rightward in the drawing).

As shown in FIGS. 10(*a*) and 10(*b*), in addition to the buckle 1 in the previous embodiment shown in FIGS. 7(*a*) and 7(*b*), the buckle 1 in this embodiment further includes an inertial mass 12 fixed to an end thereof adjacent to the slider 5 of the slider spring 6 (not shown in FIGS. 10(*a*) and 10(*b*)). The inertial mass 12 is an annular disk and slidably fitted to the projection shaft 5*a* of the slider 5. The inertial mass 12 is always urged toward the slider 5 (leftward in FIGS. 10(*a*) and 10(*b*)) by a spring force of the slider spring 6, and is pressed into contact with the slider 5 under a normal condition when the inertial force is not applied to the buckle 1.

The inertial mass 12 is not limited to the annular disk, and may have a different shape. The inertial mass 12 may also be simply interposed between the slider 5 and the slider spring 6 without being fixed to the slider spring 6. Other structures of the buckle 1 in this embodiment are the same as those of the embodiment shown in FIGS. 7(*a*) and 7(*b*).

In the buckle 1 structured in this embodiment as described above, the inertial force is also applied to the buckle 1 in the cases of (1) and (2) mentioned above, in the same way as in the previous embodiments. In this case, in the buckle 1 of this embodiment, as shown in FIG. 10(*a*), when the inertial force is applied to the inertia lever 9 in the leftward non-release direction, the counterclockwise torque TLL of the inertia lever itself is applied by the leftward lever inertial force FLL of the inertia lever itself so as to rotate the inertia lever 9 counterclockwise.

Since the inertial mass 12 attempts to move leftward by the inertia of itself, a mass inertial force FML of the inertial mass 12 is applied to the slider 5 leftward. The mass inertial force FML is further transmitted to the release button 8 via the engagement shafts 5*b* and 5*c* of the slider 5 and the pressing parts 8*f* of the release button 8. The release button 8 is moved leftward by the leftward button inertial force FBL and the leftward mass inertial force FML. Then, the second end 9*c*2 of the lever-side engagement connection part 9*c* immediately engages the vertical plane of the button-side second engagement connection part 8*e*.

Thereby, since the lever-side engagement connection part 9*c* is pressed by the button inertial force FBL and the mass inertial force FML, the torque TBL due to the clockwise button inertial force FBL and the torque TML due to the mass inertial force FML are applied to the inertia lever 9. At this time, since the two torques TLL and TBL are set to be TLL<TBL as well as the torque TML due to the mass inertial force FML is applied, the relationship TLL<TBL+TML is valid. Thus, the torque of the release button 8 in the non-release direction becomes much larger than the torque in the release direction, so that the release button 8 is more securely prevented from moving in the release direction, thereby reliably maintaining the latch between the buckle 1 and the tongue 3.

As shown in FIG. 10(*b*), when the inertial force is applied to the inertia lever 9 in the rightward release direction, the clockwise torque TLR of the inertia lever itself is applied by the rightward lever inertial force FLR of the inertia lever itself so as to rotate the inertia lever 9 clockwise.

On the other hand, since the inertial mass 12 is moved rightward by its own inertia to compress the slider spring 6, the mass inertial force FML of the inertial mass 12 is not applied to the slider 5. Accordingly, the release button 8 is moved rightward only by the rightward button inertial force FBL in the same way as the previous embodiments. Then, the first end 9*c*1 of the lever-side engagement connection part 9*c* immediately engages the vertical plane of the button-side first engagement connection part 8*d*.

Thereby, the lever-side engagement connection part 9*c* is pressed by only the button inertial force FBL, so that the torque TBL only due to the button inertial force FBL is applied to the inertia lever 9. At this time, since the two torques TLR and TBR are set to be TBR<TLR, the torque of the release button 8 in the non-release direction is larger than the torque in the release direction, so that the release button 8 is securely prevented from moving in the release direction, thereby reliably maintaining the latch between the buckle 1 and the tongue 3.

In such a manner, according to the buckle device 1 in this embodiment, the torque difference can be established also by the inertial mass 12 while the inertial mass 12 constitutes the torque-difference generating mechanism according to the present embodiment. In this case, since the annular disk-shaped inertial mass 12 is simply provided in part of the slider spring 6, the torque-difference generating mechanism has a simple structure. Other operational effects of the buckle 1 in this embodiment are the same as those of the previous embodiments.

The inertial mass 12 is incorporated in the buckle 1 shown in FIGS. 7(*a*) and 7(*b*). Alternatively, it may also be applied to the buckle 1 shown in FIG. 1 and the buckle 1 shown in FIG. 6. The torque difference can be established by providing only the inertial mass 12 in the buckle 1 having the lever-side engagement connection part 9*c* with a circular cross-section and the button-side first and second engagement connection parts 8*d* and 8*e* formed of vertical planes as the conventional buckle device 1, in which the torque difference is be set only by the inertia lever 9.

According to the present invention, the shock-proof device disposed in the buckle can be suitable for a buckle of a seatbelt equipped in a seat of a transport vehicle such as an automobile, and in particular can be more preferably used in a buckle having inertial forces applied thereto in two directions opposing each other.

The disclosures of Japanese Patent Applications No. 2003-364224 and No. 2004-147320 have been incorporated in the application.

While the invention has been explained with reference to the specific embodiments of the invention, the explanation is illustrative and the invention is limited only by the appended claims.

What is claimed is:

1. A shock-proof device to be disposed in a buckle, comprising:

a latch member for engaging a tongue, a release button associated with the latch member for releasing the tongue from the latch member, said release button comprising a button-side first engagement connection part and a button-side second engagement connection part, an inertia lever comprising a pair of opposed rotation shafts and a lever-side engagement connection part, said lever-side engagement connection part abutting against the button-side first engagement connection part and the button-side second engagement connection part to prevent the release button from moving in a release direction of the release button, and a torque-difference generating device for generating a torque difference between a first torque and a second torque applied to the inertia lever, said first torque being applied to the inertia lever by an inertial force of the release button in the release direction when the inertial force of the release button in the release direction is applied to the release button and the inertia lever so that the release button abuts against the inertia lever, and said second torque being applied to the inertia lever by an inertial force of the release button in a non-release direction when the inertial force of the release button in the non-release direction is applied to the release button and the inertia lever so that the release button abuts against the inertia lever.

2. A shock-proof device according to claim 1, wherein said torque-difference generating device is arranged such that the first torque becomes smaller than the second torque.

3. A shock-proof device according to claim 1, wherein said torque-difference generating device includes an inclined surface inclined relative to a movement direction of the release button and abutting against at least one of a first abutting surface and a second abutting surface of the release button, said first abutting surface abutting against the inertia lever when the inertial force of the release button is in the release direction, and the second abutting surface abutting against the inertia lever when the inertial force of the release button is in the non-release direction.

4. A shock-proof device according to claim 1, wherein said torque-difference generating device is arranged such that a length of a perpendicular line from a center of the pair of opposed rotation shafts of the inertia lever to a line of an action of a, force of the release button applied to the inertia lever by the inertial force in the release direction is smaller than a length of a perpendicular line from the center of the pair of opposed rotation shafts of the inertia lever to a line of action of a force of the release button applied to the inertia lever by the inertial force in the non-release direction.

5. A shock-proof device according to claim 1, wherein said lever-side engagement connection part has an elongated cross-section extending in a direction perpendicular to a straight line linking between a center of a cross-section of the lever-side engagement connection part and a center of the opposed rotational shafts of the inertia lever.

6. A shock-proof device according to claim 5, wherein said lever-side engagement connection part has a rhombic shape with round corners in section.

7. A shock-proof device according to claim 6, wherein said release button has a groove having said button-side first and second engagement connection parts therein, said lever-side engagement connection part being located in the groove.

8. A shock-proof device according to claim 7, wherein said button-side first and second engagement connection parts include top edges in substantially a same horizontal level.

9. A shock-proof device according to claim 1, wherein said button-side first and second engagement connection parts form said torque-difference generating device.

10. A shock-proof device according to claim 9, wherein one end of the lever-side engagement connection part abuts against a right side of the button-side first and second engagement connection parts, and another end of the lever-side engagement connection part abuts against a left side of the button-side first and second engagement connection parts, the inertia lever thereby being connected so as to be relatively rotatable.

11. A shock-proof device according to claim 10, wherein said inertia lever further comprises a gravity center, said pair of opposed rotation shafts and said lever-side engagement connection part being located at one side relative to the gravity center.

12. A shock-proof device according to claim 1, further comprising an inertial mass for applying a torque to the inertia lever through an inertial force thereof when the inertial force of the release button is applied in the non-release direction.

13. A buckle comprising the shock-proof device according to claim 1.

14. A seatbelt apparatus comprising the buckle according to claim 13, a seatbelt for restraining an occupant, and the tongue movably supported to the seatbelt.

* * * * *